US006189712B1

(12) United States Patent
Conrad et al.

(10) Patent No.: US 6,189,712 B1
(45) Date of Patent: Feb. 20, 2001

(54) CRANE WITH TELESCOPE JIB

(75) Inventors: Klaus Conrad, Hornbach; Thomas Krebs, Blieskastel; Michael Irsch, Lebach; Jens Fery, Saarbrücken, all of (DE)

(73) Assignee: Mannesmann AG, Düsseldorf (DE)

( * ) Notice: Under 35 U.S.C. 154(b), the term of this patent shall be extended for 0 days.

(21) Appl. No.: 09/424,604

(22) PCT Filed: May 27, 1998

(86) PCT No.: PCT/DE98/01498

§ 371 Date: Nov. 24, 1999

§ 102(e) Date: Nov. 24, 1999

(87) PCT Pub. No.: WO98/54081

PCT Pub. Date: Dec. 3, 1998

(30) Foreign Application Priority Data

May 28, 1997 (DE) ..... 197 22 889
May 26, 1998 (DE) ..... 198 24 671

(51) Int. Cl.[7] ..... B66C 23/04
(52) U.S. Cl. ..... 212/292; 212/349
(58) Field of Search ..... 212/292, 348, 212/349, 350, 264, 230, 231

(56) References Cited

U.S. PATENT DOCUMENTS 3,845,866 * 11/1974 Eucken ..... 212/292
4,036,372 * 7/1977 Rao et al. ..... 212/349
5,628,416 * 5/1997 Frommelt et al. ..... 212/292

FOREIGN PATENT DOCUMENTS

19641191 * 3/1998 (DE) .
19641193 * 3/1998 (DE) .
19631547 * 4/1998 (DE) .
19824672 * 12/1998 (DE) .

* cited by examiner

*Primary Examiner*—Thomas J. Brahan
(74) *Attorney, Agent, or Firm*—Cohen, Pontani, Lieberman & Pavane

(57) ABSTRACT

A crane includes a telescopic jib having telescopic jib sections and a base jib. The telescopic sections are arranged so that they can be axially moved into and out of the base jib individually. Locking pins are used hold the telescopic sections in place once they are in the required position. A hydraulic piston-cylinder unit arranged in the telescopic jib can push or pull individual jib sections when the respective locking bolts are removed. The movable portion of the piston-cylinder unit has two securing and locking units located at opposing ends of the movable portion. To move the jib section, one of the securing and locking units is connected to the jib section to be moved and the movement of the movable portions pushed or pulls the telescopic section. Once the jib section is moved to a desired position, the locking pin is reinserted to hold the position of the jib section. Since there are two securing and locking units, the piston-cylinder unit is approximately half the length of the telescopic section.

19 Claims, 6 Drawing Sheets

CRANE WITH TELESCOPE JIB

BACKGROUND OF THE INVENTION

1. Field of the Invention

The invention is directed to a crane with a telescope jib having a plurality of telescoping sections which are individually moved into and out of a base jib.

2. Description of the Prior Art

In a prior art crane with telescope jib known from EP 0 661 234 A1, individual telescoping sections which can telescope out are moved out and in only by a single-stage piston-cylinder unit after locking pin connections are released, and are bolted in the respective moved out or moved in positions by locking bolts which are spring-loaded in the direction of their locked positions. A piston rod of the single-stage piston-cylinder unit is articulated at the jib articulation point which terminates the inner end of the outer section. A driver device which can be coupled with receptacles of the telescoping sections is arranged in the area of the end of the cylinder from which the piston rod emerges. The driver device comprises a hydraulic block with cylinders located on opposing sides of the hydraulic block. Bolts are formed by pistons of the cylinders and can be moved in and out, of the cylinders. A hydraulic piston-cylinder unit is arranged perpendicular to the locking bolts for actuating the respective locking bolt. The hydraulic elements of the driver device are in an operative connection such that the radially located piston-cylinder unit for pulling in the respective locking bolt can be actuated only when the driver device is coupled, via the locking bolts, with the section which is to be telescoped out or in.

A comparable prior art telescoping system is known from EP 0 754 646 A1. This telescoping system has a base section and at least two sections which can telescope relative to the base section. The sections are fixed in their respective position relative to one another by removable insertion bolts (locking bolts) penetrating the walls of adjoining sections. The telescoping system further has a, preferably single-stage, lift cylinder which is limited by the sections and which is acted upon at both sides by pressure medium. This lift cylinder is provided with drivers which can be brought into an operative engagement with the respective section to be displaced. As is the case in the prior art mentioned above, the piston rod of the piston-cylinder unit is articulated at the inner end of the outer section. Both known suggestions have the disadvantage that the oil supply to the piston-cylinder unit is carried out on the inside and long distances and with the formation of a corresponding turbulence for returning the oil supply to the oil supply storage tank. This reduces the telescoping speed. Further, the weight of the main jib head is increased by the quantity of oil located in the piston-cylinder unit, which reduces the useable load.

Another prior art crane is disclosed in DE 31 25 603 A1 including a telescope jib with a base jib and three telescoping sections which can be moved in and out directly or indirectly via chain drives by means of a single-stage piston-cylinder unit. The cylinder housing of the piston-cylinder unit is articulated by its rear end at the inner end of the base jib. The piston rod is connected at the front end, via a bolt, with a cylinder box which encloses the moved out piston rod and which is connected in the vicinity of its inner end by a bolt with the side walls of the first telescoping section. This construction is disadvantageous in that all three telescoping sections can only be moved in and out jointly and it is not possible to purposely move only one telescoping section in and out of the base jib.

SUMMARY OF THE INVENTION

It is the object of the invention to provide a crane with a telescopic jib which can be produced economically while retaining the principle of the individual telescoping capability of the sections by means of a piston-cylinder unit and which enables an increased telescoping speed compared with the known prior art and whose useable load is greater.

The object of the invention is met by a crane with a telescopic jib, the telescopic jib comprising a base jib having an inner end and an outer end, first and second jib sections arranged in the base jib and axially movable therein between moved-in and moved-out positions, a piston-cylinder unit having a cylinder housing and a piston rod having a free end articulated at the inner and of the base jib, a first securing and locking unit arranged at an inner end of the cylinder housing and a second securing and locking unit arranged at an outer end of the cylinder housing, the first and second locking units having securing bolts selectively connecting to one of the first and second jib sections, and locking bolts arrangeable in recesses of the first and second jib sections for holding the first and second jib sections in the moved-in or moved-out position.

The object of the invention is also met by a crane with a telescopic jib, the telescopic jib comprising a base jib having an inner end and an outer end, first and second jib sections arranged in the base jib and axially movable therein between moved-in and moved-out positions, a piston-cylinder unit having a cylinder housing and a piston rod, the cylinder housing having a front end and a rear end articulated at the inner end of said base jib, a guiding and pulling device connected at a front end of the piston rod and extending parallel to the piston-cylinder unit, a first securing and locking unit arranged at a front end of the guiding and pulling device and a second securing and locking unit arranged at a rear end of the guiding and pulling device, the first and second locking units having securing bolts selectively connecting to one of the first and second jib sections, and locking bolts arrangeable in recesses of the first and second jib sections for holding the first and second jib sections in the moved-in or moved-out position.

In contrast to the known prior art, a securing and locking unit that can be coupled with recesses in the sections which can telescope out is fastened respectively to the inner and outer end of a displaceable element of a piston-cylinder unit. Optionally, the displaceable element of the piston-cylinder unit may be the cylinder housing, in which case the piston rod is articulated by its rear end at the inner end of the base jib, or the displaceable element of the piston-cylinder unit can be the piston rod, in which case the cylinder housing is articulated by its rear end at the inner end of the base jib. In either case, it is advantageous that the length of the piston-cylinder unit amounts to only about 50% of the length of the main jib due to the arrangement of two securing and locking units. A shorter piston-cylinder unit means a shorter bending length, so that the piston-cylinder unit may be designed more favorably with respect to dimensioning while retaining the same lifting force. This, in turn, has a direct effect on the weight which, despite the added weight due to the arrangement of a second securing and locking unit, is lower in comparison to a piston-cylinder unit which extends 100-% of the length of the main jib. Two lift procedures are required for fully telescoping each individual telescoping section. The embodiment with a cylinder housing articulated at the base jib is preferably selected, wherein the piston rod is connected with a guiding and pulling device oriented parallel to the piston-cylinder unit. Two securing and locking units are fastened to the inner and outer end of the guiding and pulling device. The guiding and pulling device has a crosspiece fastened to the front end of the piston rod and two guide elements located, respectively, to the right and left of the cylinder housing. The front end of the guide element is connected with the crosspiece on one side and the front end area of the guide element is connected with the second securing and locking unit on the other side and the rear ends are connected with the first securing and locking unit. The crosspiece preferably has a flat section or profile which is stiffened by a web plate and the guide elements comprise box sections or profiles with internal plate reinforcements.

The securing and locking unit arranged at the inner end has a bushing which is displaceable on the cylinder housing of the piston-cylinder unit and which is connected with the two guide elements. A sliding piece which is in an operative connection mechanically with the two securing bolts and the gripper by means of guide grooves and guide rings is arranged on this bushing so as to be displaceable. The arrangement of guide grooves and guide rings is selected in such a way that the respective locking bolt can be pulled only when the two securing bolts are moved into the respective lateral recesses of the telescoping sections and, conversely, it is only possible for the two securing bolts to move out of the respective recesses when the respective locking bolt is set. The actuating element for the sliding piece is preferably a piston-cylinder unit connected with the guide elements. This piston-cylinder unit is arranged so as to be oriented parallel to the cylinder housing of the piston-cylinder unit moving the sections. In the securing and locking unit arranged at the outer end, the arrangement of a bushing may be omitted. The rest of the elements are coincident. For the purpose of setting the locking bolts, the sections also have recesses in the central area in addition to the recesses provided at the inner and outer end. These additional recesses are preferably arranged one above the other at approximately 50% of the length of the sections. This means that the locking is carried out by means of the securing and locking unit arranged at the inner end for sliding in and out to approximately 50% of the length and locking is carried out by means of the securing and locking unit arranged at the outer end for sliding in and out further between 50 and 100%.

The preferred construction for the telescoping capability of the sections using a known piston-cylinder unit has the advantage that it can be produced economically and has good guiding with respect to the securing and locking unit. Moreover, the oil supply to the piston-cylinder unit is facilitated in that the oil feed at the base side can be realized directly at the end of the base jib with the cylinder housing. The oil quantity located in the cylinder housing can accordingly be returned by hydraulic connections having a large nominal width to the hydraulic tank along the shortest path without turbulence, which is required for increasing speed during the telescoping process. The center-of-gravity position of the moved out main jib is shifted toward the base point of the main jib by the inherent weight of the hydraulic oil of the cylinder, which means a reduction of the weight of the main jib head and, therefore, an increase in load. The mechanical locking which cannot be influenced by electric or hydraulic interference is also advantageous.

BRIEF DESCRIPTION OF THE DRAWING

In the drawings wherein like reference characters denote similar elements throughout the several views.

DETAILED DESCRIPTION OF THE PREFERRED EMBODIMENTS

Figure 1A:
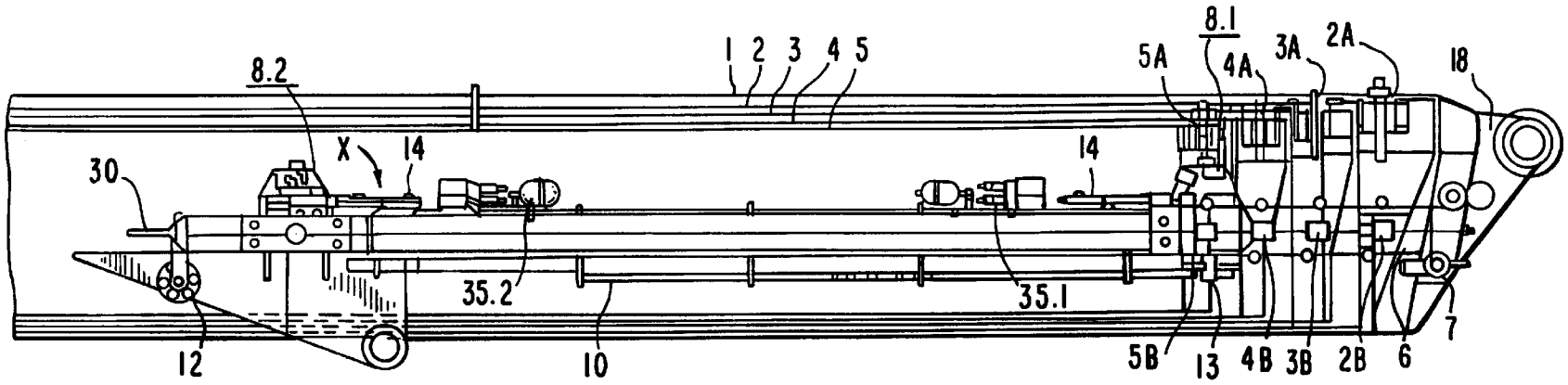
FIG. 1*a* is a side view of a rear end of a telescopic jib according to an embodiment of the invention in the moved-in position.
Figure 1B:
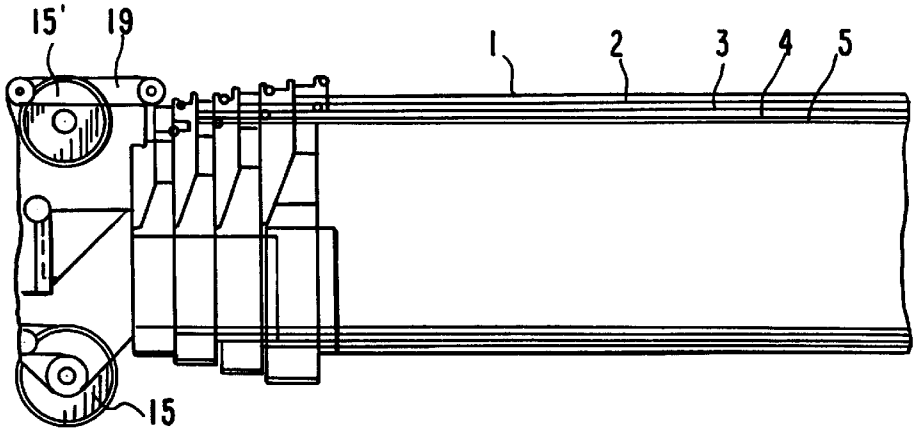
FIG. 1*b* is a side view of a front end of the telescopic jib of FIG. 1*a;*
Figure 2A:
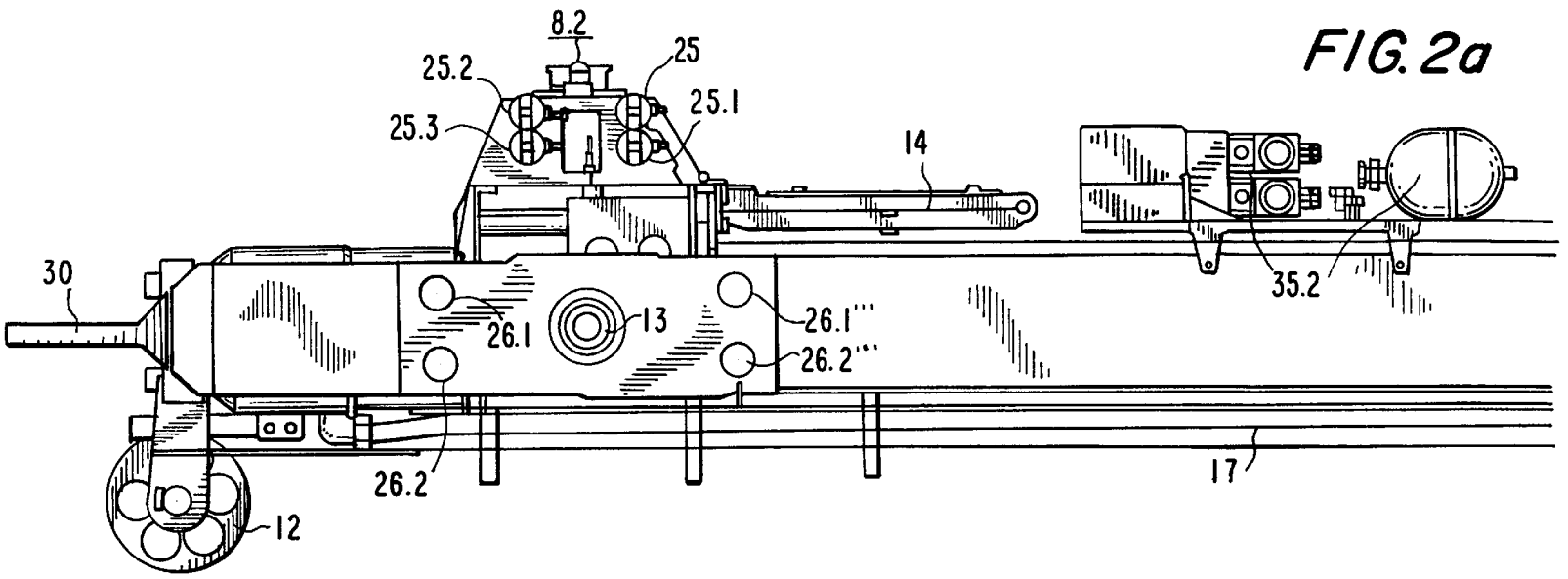
FIG. 2*a* is a more detailed of area X in FIG. 1*a;*
Figure 2B:
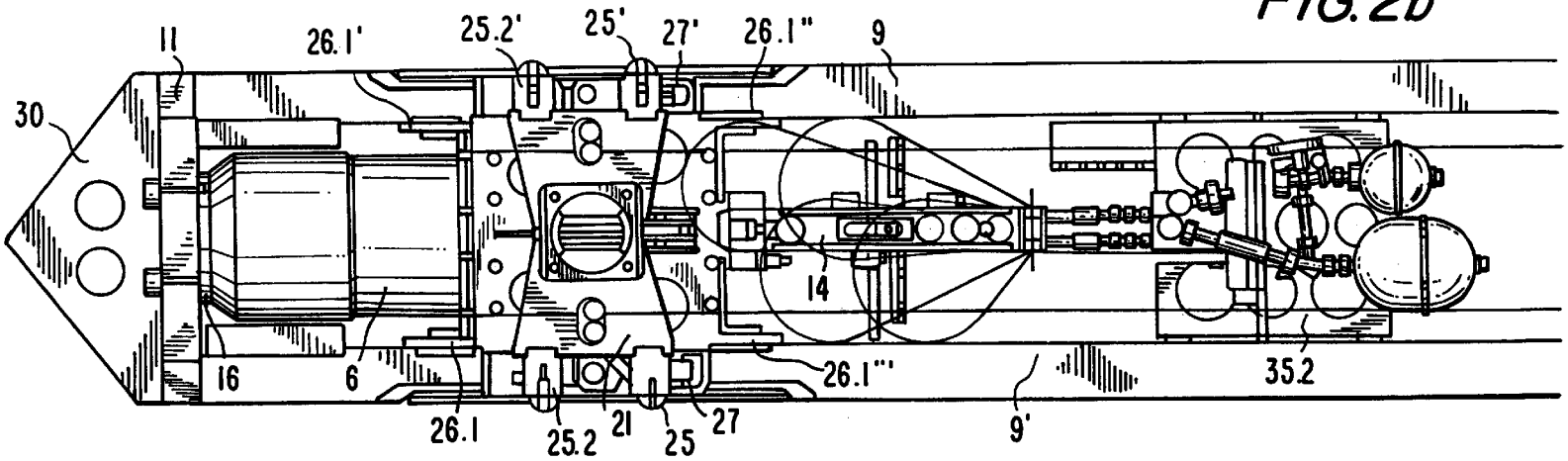
FIG. 2*b* is a top view of the detailed area shown in FIG. 2*a;*

According to FIGS. 1*a*, 1*b* and 2*a*, 2*b*, a plurality of telescoping sections 2–5 are mounted so as to be axially displaceable one inside the other in a base jib 1 having an oval cross section. A constructional unit of this type may be used as a telescope jib for stationary or mobile cranes. The telescoping capability of the individual telescoping sections 2 to 5 is effected in this embodiment example by a single-stage piston-cylinder unit, having a cylinder housing 6 and a piston rod 16. In contrast to conventional constructions, the cylinder housing 6, rather than the piston rod 16 (FIG. 2*b*), is articulated by a bearing 7 at a jib articulation piece 18 terminating the base jib 1. In the first to fourth telescoping sections 2 to 5, respective locking bolts 2A to 5A are provided in the area of the rear bearing. The telescoping sections 2–5 are connected with one another by these locking bolts 2A to 5A. Further, each telescoping section 2 to has a recess 2B–5B on a first side and a recess 2B'–5B' on a second side, respectively. A first securing and locking unit 8.1 includes first and second securing bolts 13–13' insertable into recesses 2B–5B and 2B'–5B', respectively. Guide elements 9, 9', each having a front end and a back end are arranged on opposing sides of the cylinder housing 6. A crosspiece 11 which is stiffened by a web plate 30 is connected to the front ends of the guide elements 9, 9'. A support roller 12 is arranged in the area of the crosspiece 11 for support. Head rollers 15, 15' are provided at the head piece 19 of the base jib 1 for the rope guide, not shown in more detail. According to the invention, a second securing and locking unit 8.2 is arranged at the piston-cylinder unit at the outer end, wherein, in this case, the piston-cylinder unit is single-stage. The second securing and locking unit 8.2 coincides with the first securing and locking unit 8.1 arranged at the inner end. A drive 14 faces the inner end of the telescope jib. The hydraulic supply of the drive 14 of the first and second securing and locking units 8.1, 8.2 is carried out by first and second control and bubble storage units 35.1, 35.2. Depending on the length of the piston-cylinder unit moving the sections 2 to 5, the two control and bubble storage units 35.1, 35.2 may be combined to form a block. A guide construction 10 is arranged for the energy supply 17 of the respective first and second securing and locking units 8.1, 8.2 at the underside of the piston-cylinder unit.

Figure 3:
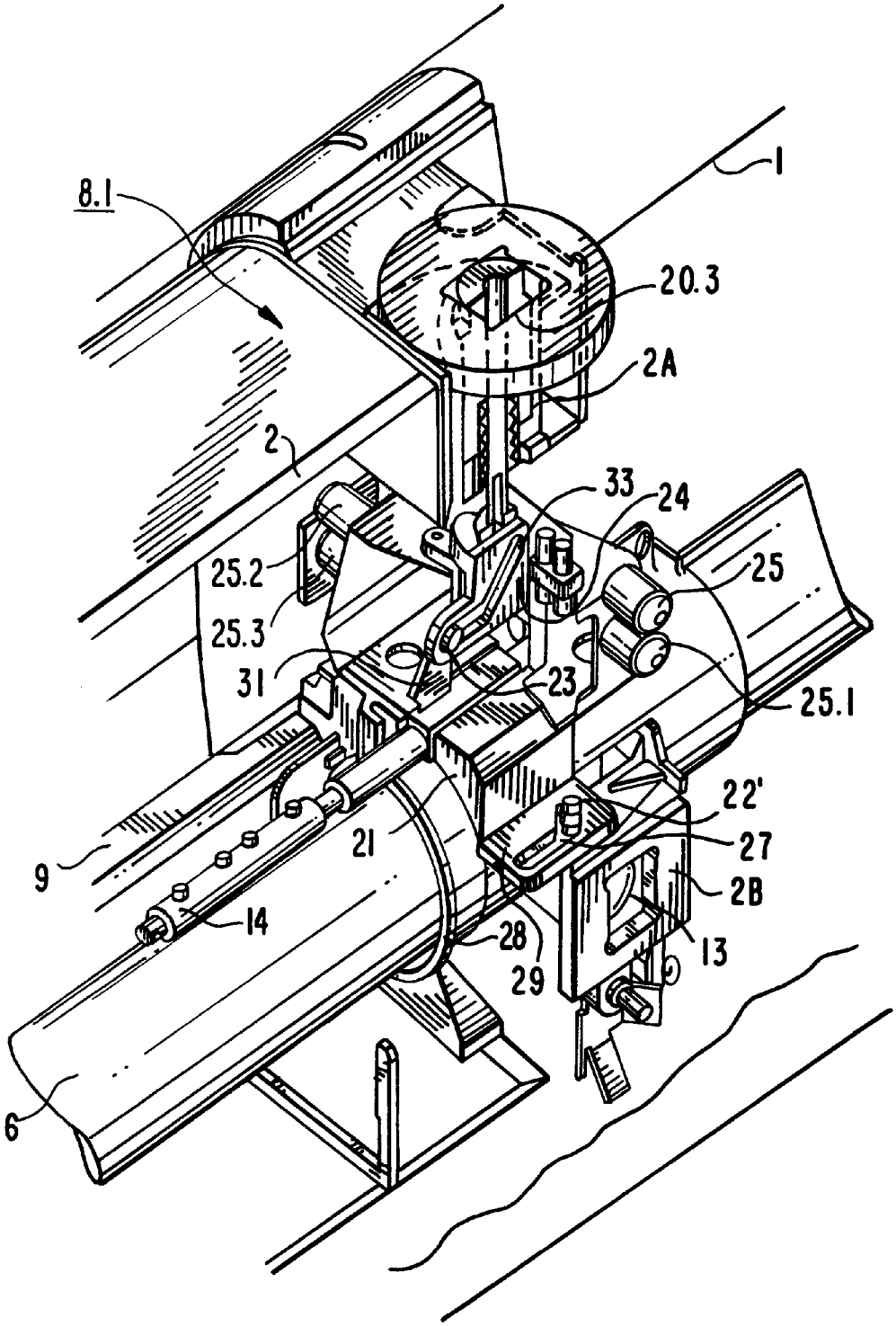
FIG. 3 is a perspective view of a first securing and locking unit according to the present invention.

FIG. 3 shows a perspective view of the details of the first securing and locking unit 8.1 arranged at the inner end. It comprises a bushing 28 which is arranged on the cylinder housing 6 of the piston-cylinder unit so as to be axially displaceable theron and which is connected with the end regions of the guide elements 9, 9'. The connection of guide elements 9, 9' to the bushing 28 is carried out by means of bolts 26.1, 26.2 to 26.1", 26.2" (see FIGS. 2*a, b*). A sliding piece 21 is arranged on the bushing 28 so as to be displaceable. The displacement of the sliding piece 21 on the busing 28 is carried out by a piston-cylinder unit 14 which is oriented parallel to the cylinder housing 6 and which is fixedly connected, in turn, with the bushing 28. Web plates 29, 29' lying in the horizontal plane and provided with a guide grooves 27, 27' are respectively arranged to the right and left of the sliding piece 21. The guide grooves 27, 27' cooperate with guide rings 22, 22' (see also FIGS. 4, 5) which are connected with the respective securing bolts 13, 13'. The two securing bolts 13, 13' located opposite one another are moveable in and out of the respective lateral recesses 2B–5B, 5B' and 2B' (see also FIGS. 4, 5). A fork plate 31 with a guide ring 23 is provided at the sliding piece 21 so as to be oriented perpendicular to the two web plates 29, 29'. This guide ring 23 cooperates with a guide groove 33 arranged at a gripper 24. Which is guided in a bushing 32 in accordance with the views in FIGS. 4, 5. Proximity switches 25, 25.1, 25', 25.1', 25.2, 25.3, 25.2', 25.3' are arranged in pairs in the upper region of the sliding piece 21. These proximity switches signal approach to one of the lateral recesses 2B, 2B' to 5B, 5B' during the displacement of first securing and locking unit 8.1 along the cylinder housing 6.

Figure 4A:
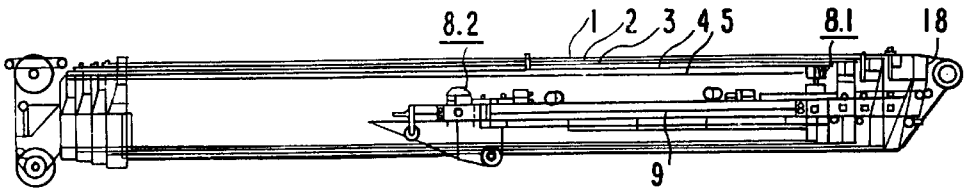
FIGS. 4*a*–4*d* show stages for moving out one jib section of the telescopic jib of FIG. 1*a;*
Figure 4B:
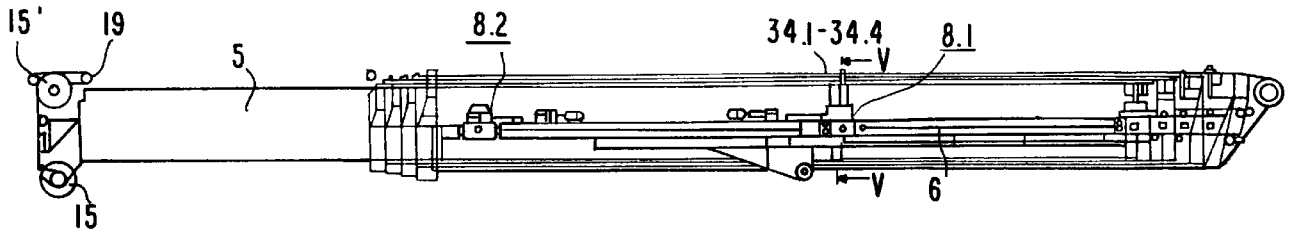

The individual steps for telescoping are shown in FIGS. 4*a*–4*d* in step sequences 4*a*–4*d*. Step sequence FIG. 4*a* is identical to the view in FIGS. 1*a, b*, so that a description need not be repeated. For moving out, the piston-cylinder unit is actuated and the piston rod 16, including the guide elements 9, 9', is moved toward the left. In order to move out the innermost telescoping section 5, the first securing and locking unit 8.1 arranged at the inner end is moved along the cylinder housing until it can be coupled with the corresponding locking bolt 5A. Before disengaging the locking of the fourth telescoping section 5 with the third telescoping section 4, the securing bolts 13, 13' are pushed into the lateral recesses 5B, 5B' provided for this purpose corresponding to the view in FIG. 4. In this way, the securing and locking unit 8.1 is bolted to the innermost telescoping section 5. According to step sequence FIG. 4*b*, the innermost telescoping section 5 is partially slid out by displacing the piston rod 16 toward the left. FIG. 4*b* shows the end state of this first move-out phase. The locking bolt 5A of the innermost telescoping section 5 is then pushed into the recess 34.1 located approximately in the center of the third telescoping section 4. In this way, the innermost telescoping section 5 which is partially pushed out is locked with the third telescoping section 4.

Figure 4C:
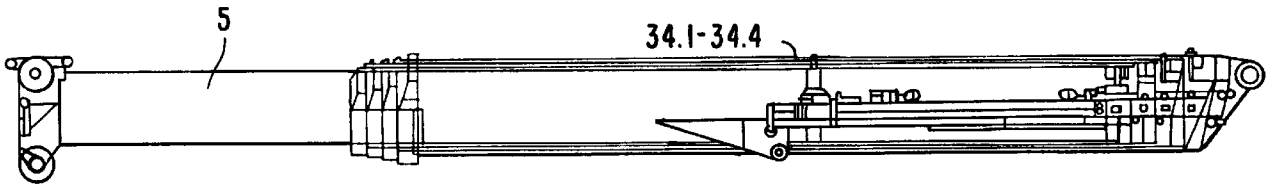

FIG. 4*c* shows the end state of the return movement of the first securing and locking unit 8.1 and the engagement of the locking bolt 5A of the fourth telescoping section 5 by means of the second securing and locking unit 8.2 arranged, according to the invention, at the outer end of the piston-cylinder unit. However, before this locking can be disengaged, the securing bolts 13, 13' are slid into the lateral recesses 5B, 5B' provided for this purpose. In this way, the second securing and locking unit 8.2 is bolted with the innermost telescoping section 5.

Figure 4D:
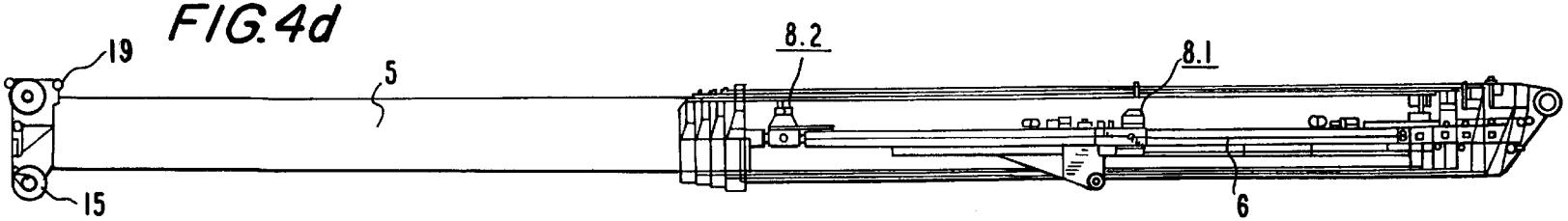

FIG. 4*d* shows the end state in which the innermost telescoping section 5 is completely slid out, after activation of the piston-cylinder unit. For the purpose of locking the fourth telescoping section 5 with the third telescoping section 4, the locking bolt 5A engages in the corresponding receptacle of the third telescoping section 4. At the same time, the two securing bolts 13, 13' are moved out of the lateral recesses 5B, 5B'. The movable part of the piston-cylinder unit then moves back into the initial position again in a manner comparable to FIG. 4*a*.

The sliding out of the rest of the telescoping sections 2 to 4 will not be shown or described so as to save space and avoid repetition of the process steps.

Figure 5:
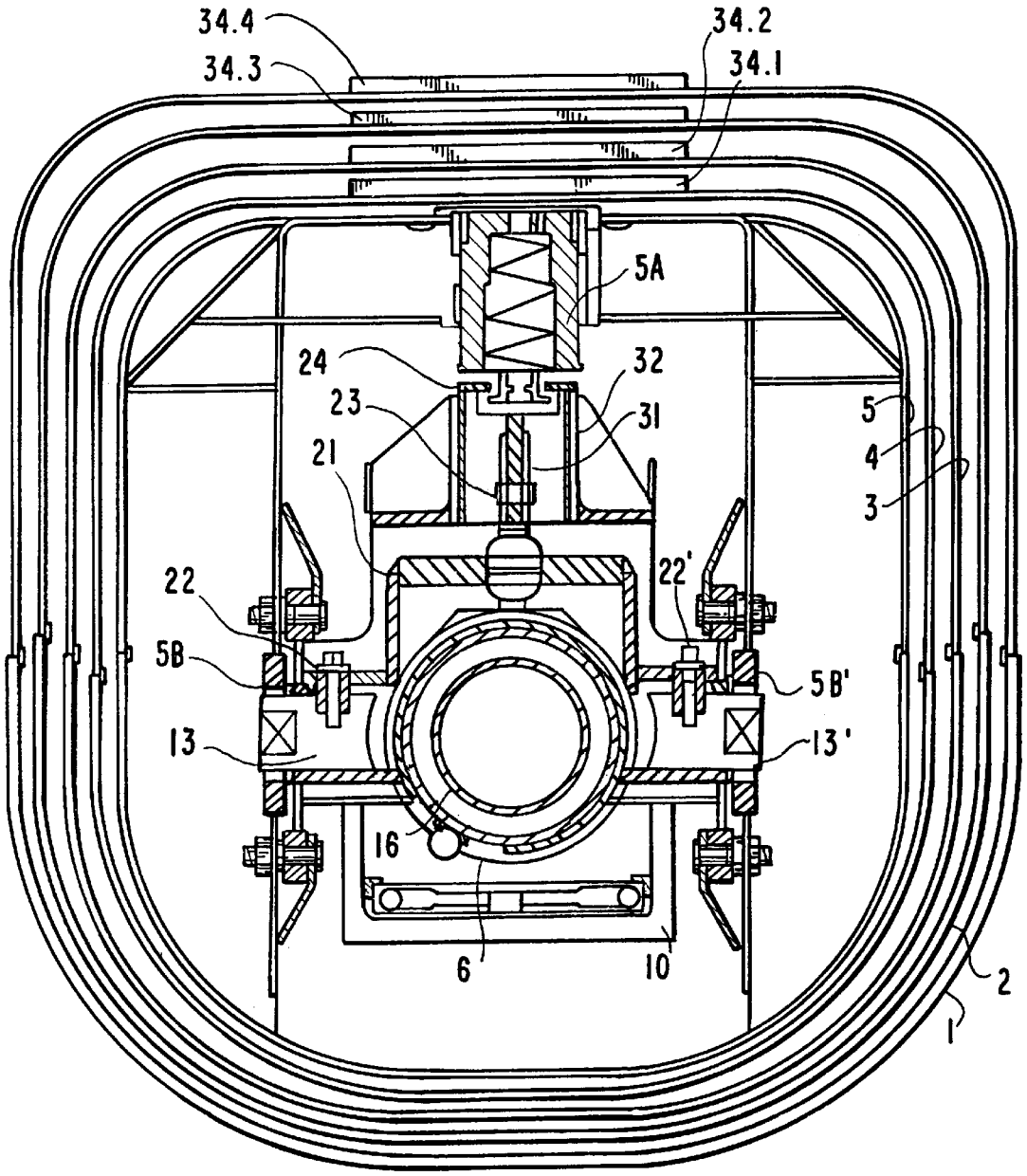
FIG. 5 is a sectional view of the telescopic jib of FIG. 4*b* along line V—V with the securing elements in a locked position.

FIG. 5 shows a section along the in direction V—V from FIG. 4*b*. This view, shows a situation in which the innermost telescoping section 5 is bolted with the securing and locking unit 8.1 arranged at the inner end. For this purpose, the securing bolts 13, 13' arranged in the first securing and locking unit 8.1 are moved toward the right and left into the recesses 5B, 5B' arranged in the innermost telescoping section 5. By means of this bolting, the innermost telescoping section 5 is bolted to the piston-cylinder unit via the first securing and locking unit 8.1. The locking bolt 5A is then pulled out of the upper recess 34.1, so that the innermost telescoping section 5 can be slid out by moving the piston rod 16.

Figure 6:
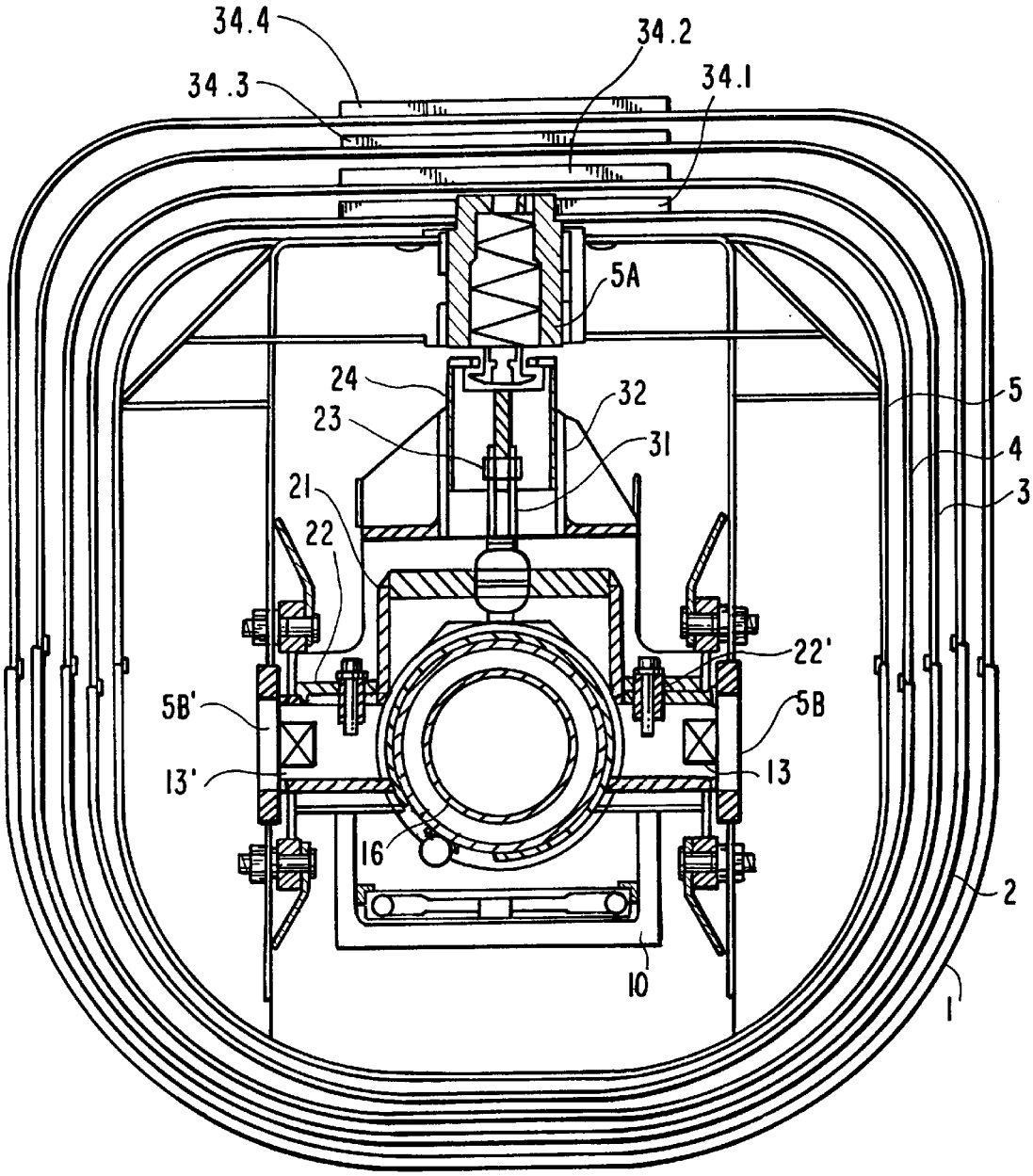
FIG. 6 is a sectional view similar to FIG. 5 with the securing elements in the unlocked position.

FIG. 6 shows the same section V—V in FIG. 4*b*, with the difference that the locking bolt 5A of the innermost telescoping section 5 is pushed into the upper recess 34.1 of the third telescoping section 4. Consequently, the securing bolts 13, 13' are moved out of the lateral recesses 5B, 5B' by the mechanical coupling described with reference to FIG. 3.

What is claimed is:

1. A crane with a telescopic jib, said telescopic jib comprising:

a base jib having an inner end and an outer end;

first and second jib sections arranged in said base jib and axially movable therein between moved-in and moved-out positions;

a piston-cylinder unit having a cylinder housing and a piston rod having a free end articulated at said inner and of said base jib;

a first securing and locking unit arranged at an inner end of said cylinder housing and a second securing and locking unit arranged at an outer end of said cylinder housing, said first and second locking units having securing bolts selectively connecting to one of said first and second jib sections; and locking bolts arrangeable in recesses of said first and second jib sections for holding said first and second jib sections in the moved-in or moved-out position.

2. The crane of claim 1, wherein said recesses in said first and second jib sections comprise a central recess in a central area of said first and second jib sections and inner end and outer end recesses at the inner and outer ends of said first and second jib sections.

3. The crane of claims 2, wherein said central recesses are arranged at approximately half the length of the first and second jib sections.

4. The crane of claim 1, wherein said first and second securing and locking units each comprise a hydraulic block with opposing cylinders for said securing bolts and a locking bolt piston-cylinder unit arrange perpendicular to said opposing cylinders for actuating said locking bolts.

5. The crane according to claim 4, wherein said locking bolt piston-cylinder unit is operatively arrange such that said locking bolts are removable only when said securing bolts are engaged.

6. A crane with a telescopic jib, said telescopic jib comprising:

a base jib having an inner end and an outer end;

first and second jib sections arranged in said base jib and axially movable therein between moved-in and moved-out positions;

a piston-cylinder unit having a cylinder housing and a piston rod, said cylinder housing having a front end and a rear end articulated at said inner end of said base jib;

a guiding and pulling device connected at a front end of said piston rod and extending parallel to said piston-cylinder unit;

a first securing and locking unit arranged at a front end of said guiding and pulling device and a second securing and locking unit arranged at a rear end of said guiding and pulling device, said first and second locking units having securing bolts selectively connecting to one of said first and second jib sections; and locking bolts arrangeable in recesses of said first and second jib sections for holding said first and second jib sections in the moved-in or moved-out position.

7. The crane of claim 6, wherein said recesses in said first and second jib sections comprise a central recess in a central area of said first and second jib sections and inner end and outer end recesses at the inner and outer ends of said first and second jib sections.

8. The crane of claim 7, wherein said central recesses are arranged at approximately half the length of the first and second jib sections.

9. The crane of claim 6, wherein said first and second securing and locking units each comprise a hydraulic block with opposing cylinders for said securing bolts and a locking bolt piston-cylinder unit arrange perpendicular to said opposing cylinders for actuating said locking bolts.

10. The crane according to claim 9, wherein said locking bolt piston-cylinder unit is operatively arrange such that said locking bolts are removable only when said securing bolts are engaged.

11. The crane according to claim 6, wherein said guiding and pulling device comprises a crosspiece fastened to said front end of said piston rod and two guide elements located on opposing sides of said cylinder housing, wherein an end of said two guide element connected to said cross piece is connected to said second securing and locking unit and the opposing ends of said two guide elements are connected to said first securing and locking unit.

12. The crane of claim 11, wherein said cross piece has a flat profile and comprises a stiffener.

13. The crane of claim 11, wherein said two guide element have rectangular cross sections.

14. The crane of claim 13, wherein the inner sides of the guide elements further comprise stiffened plates.

15. The crane of claim 6, wherein said first securing and locking unit comprises a bushing displaceably arranged on said cylindrical housing and connected to said two guide elements, and wherein both of said first and second securing and locking units comprise a gripper for selectively engaging said locking bolt and sliding pieces connected with an actuating element, said sliding piece being in operative connection with said securing bolts and said gripper.

16. The crane of claim 15, wherein said sliding piece comprises opposing web plates comprising guide grooves, guide rings arranged in said guide grooves and arranged on said first and second securing bolts, said sliding piece further comprising a fork plate comprising a guide ring and extending perpendicular to said web plates, said guide ring in cooperative engagement with a groove in said gripper, and further comprising a bushing in which said gripper is guided.

17. The crane of claim 16, wherein said groove in said gripper and said guide grooves in said web plates are arranged so that said locking bolt is engage when said securing bolts are disengaged and said securing bolts are engaged when said locking bolt is removed from said recess.

18. The crane of claim 15, wherein said first and second securing and locking units each comprise an actuating element for actuating said sliding piece, said actuating device comprising a piston-cylinder unit.

19. The crane of claim 18, wherein said actuating element of each of said first and second securing and locking units is arranged parallel to said cylinder housing.

* * * * *